United States Patent [19]

Buck et al.

[11] 4,428,898

[45] Jan. 31, 1984

[54] U-SHAPED PLASTERBOARD

[75] Inventors: Yves Buck, Clermont en Beauvaisis; Adrien Delcoigne, Chantilly, both of France

[73] Assignee: Isover Saint-Gobain, Neuilly, France

[21] Appl. No.: 336,904

[22] Filed: Jan. 4, 1982

Related U.S. Application Data

[62] Division of Ser. No. 118,099, Feb. 4, 1980, Pat. No. 4,361,995.

[30] Foreign Application Priority Data

Feb. 5, 1979 [FR] France ..... 79 02922

[51] Int. Cl.[3] ..... D01D 5/20

[52] U.S. Cl. ..... 264/167; 264/283; 264/333

[58] Field of Search ..... 264/108, 285, 286, 287, 264/284, 296, 139, 283, 145, 167, 333; 156/39, 42, 45; 52/18, 69, 70, 71, 600, 388

[56] References Cited

U.S. PATENT DOCUMENTS

| | | | |
|---|---|---|---|
| 2,047,197 | 7/1936 | Fordyce | 264/DIG. 57 |
| 2,505,152 | 4/1950 | Shearer | 264/DIG. 57 |
| 3,197,536 | 7/1965 | French | 264/339 |
| 3,289,371 | 12/1966 | Pearson et al. | 264/309 |

*Primary Examiner*—Donald E. Czaja
*Assistant Examiner*—James C. Housel
*Attorney, Agent, or Firm*—John F. A. Earley

[57] ABSTRACT

The present invention concerns a construction element, in particular containing plaster, in a plate which includes reinforcements distributed throughout the greater part of its thickness, such that along lines parallel to the sides of the plate, the reinforcements are concentrated in predetermined zone of the thickness and the plaster is removed plumb with these lines which may thus become folding lines to achieve a non-planar element. The invention also concerns a process and apparatus for manufacturing these construction elements. The invention applies, in particular, to the manufacture of U-shaped plasterboard panels for use in ceilings and in building structures.

8 Claims, 13 Drawing Figures

U-SHAPED PLASTERBOARD

This patent application is a division of U.S. patent application Ser. No. 118,099, filed by us on Feb. 4, 1980, now U.S. Pat. No. 4,361,995.

CROSS-REFERENCES TO OTHER APPLICATIONS

This patent application is based on our French patent application Ser. No. 79-02922 filed Feb. 5, 1979, in the French Patent Office, and is also related to the subject matter of the following U.S. patent applications: Delcoigne & Lanneau Ser. No. 3,415, filed Jan. 15, 1979 now U.S. Pat. No. 4,334,786; Delcoigne & Lanneau Ser. No. 3,416, filed Jan. 15, 1979 now U.S. Pat. No. 4,257,710; and Delcoigne & Lanneau Ser. No. 3,414, filed Jan. 15, 1979 now U.S. Pat. No. 4,288,263, all of said patent applications being incorporated herein by reference.

TECHNICAL FIELD

The present invention concerns a construction element, in particular containing plaster.

The construction element, in plates, includes reinforcements distributed throughout the greater part of its thickness, such that along lines parallel to the sides of the plate, the reinforcements are concentrated in a determined zone of the thickness and that, eventually ulteriorly, the material of the matrix, in particular the plaster, is removed plumb with these lines which may thus become folding lines to achieve a non-planar element.

The invention equally concerns a process and a device for manufacturing these construction elements.

The invention applies, in particular, to the manufacture of plasterboard in the shape of a U, for use in ceilings and in building structures.

BACKGROUND OF THE INVENTION

The present invention concerns a construction element containing plaster for use in ceilings or vertical elements, the doubling of partition-walls, and in general for the equipping of any building structure.

It is known from French Pat. No. 2 376 272 how to set up dry partitions by means of plaster panels covered with cardboard along two opposite parallel faces of the panel with the faces being articulated around a hinge formed by one of the thicknesses of the cardboard capable of being folded back at a right angle to form a brace. In order to render the faces foldable, a groove is made in the thickness of the plaster, taking care to leave intact the cardboard cover on one side so that it may serve as a hinge.

But the failure of the plaster to hold when the cardboard cover is weakened or has disappeared as a result of moisture, or fire, or handling without precautions, the need of a finishing treatment of the cardboard surface, the need to improve the resistance to shocks, led to the manufacture of panels without cardboard, reinforced in all their thickness or at least in the greater part of their thickness, for instance by glass fiber, and displaying the same finish as the traditional plaster cover. It is no longer a question, in such panels, to make a groove to allow the folding back of the faces, without at the same time automatically cutting all or part of the reinforcement, for example, glass fibers, placed in the interior of the panels themselves. Moreover, when these reinforcements are distributed in all the thickness, or even only in a certain portion of the thickness, or if they are arranged at several levels in the thickness, the folding of the faces places those situated on the outside of the fold in tension and makes them break and/or break away from the matrix which they are meant to reinforce.

The present invention proposes construction elements in plates, particularly in plaster, comprising reinforcements distributed in all their thickness, in which the reinforcements are concentrated in a predetermined zone of the thickness along fold lines parallel to the sides of the plates.

Advantageously, these reinforcements are concentrated along these fold lines, until they form but a single plane of reduced thickness in the very thickness of the reinforcements.

In a manner of preferred realization, the plaster is eliminated along these fold lines.

The present invention concerns plaster plates reinforced by natural or artificial fibers, textile threads, organic or mineral fibers, weavings, non-weavings, glass fibers, metallic fibers, lattices formed with the previously mentioned fibers, fiber sheets, for instance of continuous tangled-up glass, or by combinations of these different reinforcements, thus, for example, preferentially by a sheet of continuous entangled glass fibers covered above the below by one or several glass fiber lattices.

In one mode of the invention, the fold lines are parallel.

In one advantageous mode of the invention, the various constituent panels of the plates are separated by the fold lines and are folded back in relation to one another so as to form a non-planar construction element.

In another mode of the preferred invention, the construction elements have two fold lines delimiting a principal panel and two secondary panels or flaps arranged each on one side of the main panel, the said flaps being raised above the plane of the main panel, approximately at an angle of 90°, in such a way as to form a U-shaped trough. Advantageously, in order to obtain a good resistance to flection of the construction elements thus obtained, the flaps have a height which is in the range of 1/40th of the width of the main panel of said construction elements.

The construction elements in the form of trough are capable of being used in ceilings, and may be associated by jointing.

When only a juxtaposition of the trough is preferred, the fold lines preferably are in a plane situated at the level or in the vicinity of the lower visible face of the troughs.

When it is preferred to joint with a coating, the plane of the fold lines shall on the contrary be brought appreciably to mid-thickness of the main panel and the flaps of the trough form with the main panel a slightly obtuse angle in the range of 95% so as to permit the jointing by a sufficient thickness of coating.

Advantageously, these construction elements carry insulation.

In order to fabricate such construction elements, a plate is formed by casting a liquid mixture of plaster and water and a reinforcement is introduced in the said mixture. The reinforcement is concentrated in a single plane parallel to the plane of the casting along certain fold lines, and the reinforcement is held in position along these fold lines during the evolution of the setting of the plaster until that postion holds by itself. The plaster is then driven out plumb with these fold lines and one folding effected.

The positioning of the reinforcement along the fold lines may be modified before the mixture attains a consistency which corresponds to the F.L.S. 100 fluidity and the modifying action is maintained at least until the mixture has a fluidity of F.L.S. close to 60.

Preferentially, the plaster is removed from around the fold lines at least from the moment when the mixture has the F.L.S. 60 fluidity.

The invention will now be described in greater detail with reference to the Figures which represent:

FIG. 4 shows a strip of construction elements according to the invention, folded accordion-like;

FIGS. 7A, 7B, and 7C show trough-like elements in which the fold lines are placed at different levels in the thickness of the plates;

FIG. 8 shows a trough-like element for supporting insulation;

FIG. 9 shows a diagrammatic view of apparatus for manufacturing the construction elements according to the invention;

FIG. 10 shows a diagrammatic view of a disk for forcing reinforcement into the thickness of the plates; and FIG. 11 shows another means for concentrating the reinforcements.

Figure 1:
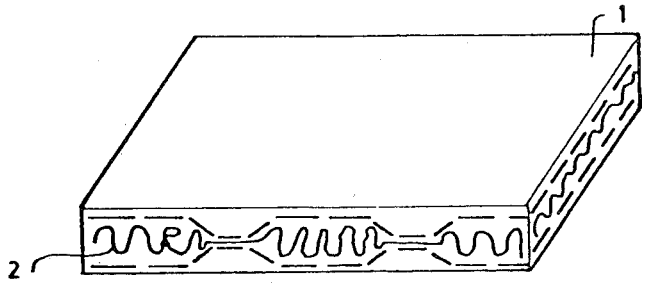
FIG. 1 is a view in perspective showing a plasterboard plate reinforced in its mass, with the reinforcement concentrated in one plane along certain lines.

FIG. 1 represents a construction element according to the invention, constituted by a plate 1 of plaster, reinforced at least in its mass by visible glass fibers 2 in the vertical section of the plate. Along certain fold lines parallel to the sides of the plate, the glass fibers 2 are concentrated in predetermined zones of thickness, while everywhere else they are distributed in practically the whole thickness of the plate. Preferentially, the glass fibers are concentrated along these fold lines until they form but one plane reduced to the thickness of the glass fibers 2.

Figure 2:
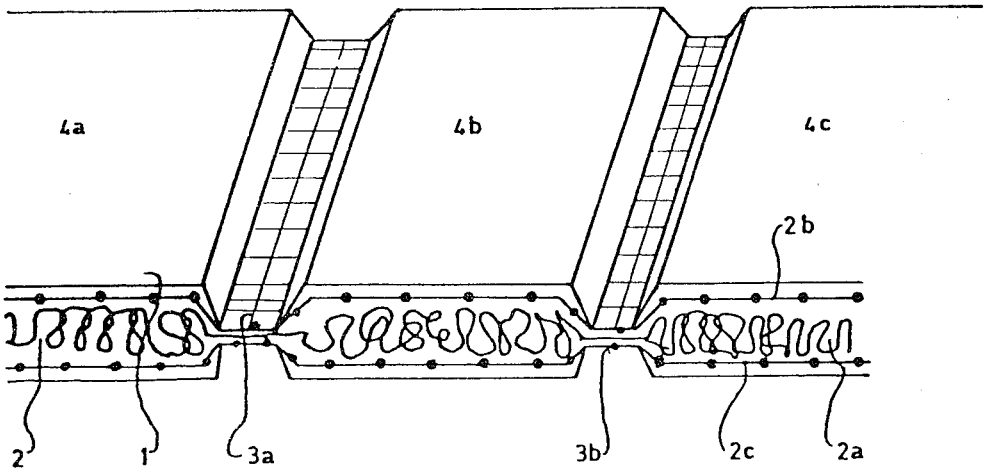
FIG. 2 shows a strip of plaster plates reinforced in their mass, divided into plates or panels by fold lines.

FIG. 2 shows a strip of construction elements obtained from the construction element of FIG. 1. The plate 1 of reinforced plaster is again reinforced at least in its mass by glass fiber 2, the glass fibers being concentrated in predetermined zones of the thickness along certain fold lines parallel to the face of the plate. Moreover, plumb with these lines, a portion of the plaster has been removed. Thus the plate 1 has fold lines 3, in this instance in FIG. 2 fold lines 3*a* and 3*b*, comprising solely reinforcing fibers 2. The fold lines 3*a*, 3*b* define panels or plates 4*a*, 4*b*, 4*c* . . . articulable in relation to one another by folding around hinges that are constituted by the fold lines 3*a*, 3*b*.

Figure 3:
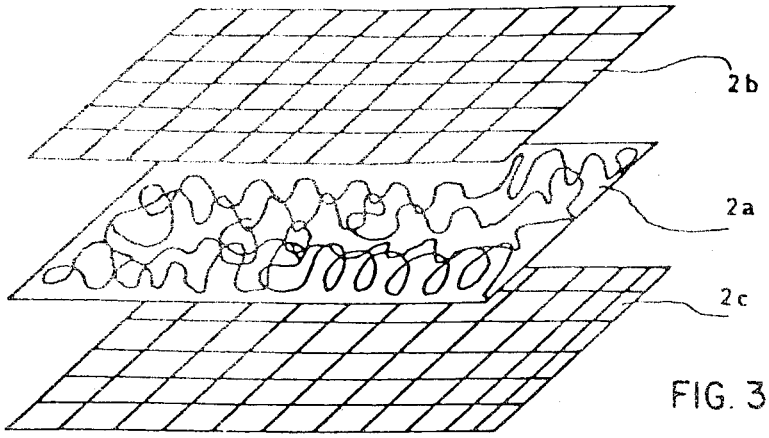
FIG. 3 is an exploded view of an example of an association of reinforcements introduced in the plaster.

While within each of the panels 4*a*, 4*b*, 4*c* the glass fiber reinforcement is distributed in the thickness of the product, along the hinges of fold lines 3*a*, 3*b* the different reinforcement fibers 2 are assembled preferentially in a single plane parallel to the faces of the plate 1. These elements of construction of FIGS. 1 and 2 are, for example, reinforced by a plurality of reinforcing elements made of glass, the said reinforcing elements being shown in exploded view in FIG. 3. It is thus possible to reinforce by a sheet 2*a* of curled and entangled continuous glass fibers enclosed above and below by a lattice 2*b* and 2*c* of glass fibers preventing a too serious bucking of the fibers of the glass fiber sheet 2*a* in the thickness of the product, and preventing loops from passing beyond the faces of the product or from being visible on said faces. One can see in FIG. 2 that along the hinges of fold lines 3*a* and 3*b* the plaster is absent and that only the reinforcements are visible, in particular the upper lattice 2*b*.

Other reinforcements 2 may be used: textile fibers, natural or synthetic some of which at least are disposed in such a direction that the joining between two panels such as 4*a* and 4*b* be ensured, independent metal fibers or in sheets, glass screens, mats of glass fibers, that is to say sheets layers, tissues or webs of said fibers, lattices alone, for example of glass fibers, wovens, non-wovens, sheets of continuous glass fibers identical to sheet 2*a* alone, organic or mineral fibers, thus for example made of glass, cut, provided however that some of them be disposed transversally to the fold lines 3 and that they have a length such as to ensure the joining between two panels 4, that is to say a minimum length of 5 to 6 centimeters for plaster panels with a 6 millimeter thickness approximately.

The fold lines such as 3*a*, 3*b* may be parallel as shown in FIG. 2, but they may also not be parallel when it is desired to achieve, by folding, ducts or sheaths for example in the form of frustum of a pyramid. In FIGS. 1 and 2, the plane which contains the reinforcements 2 along the fold lines is a median plane parallel to the faces of the panel of plastic plate 1, preferrably at mid-thickness of the plate or panel. The level of that plane in the thickness of the plate may be different. The plane containing the fold lines 3 may be close to one face of the panel, be on the other face or be situated at any other level in the thickness of the said plate.

The width of the fold line 3 free from plaster is a function of the thickness of the plate 1, of the height of the plane containing the fold lines in the thickness of the plate, of the direction of folding of the plates in relation to the others, and of the angle of the folding.

Figure 4:
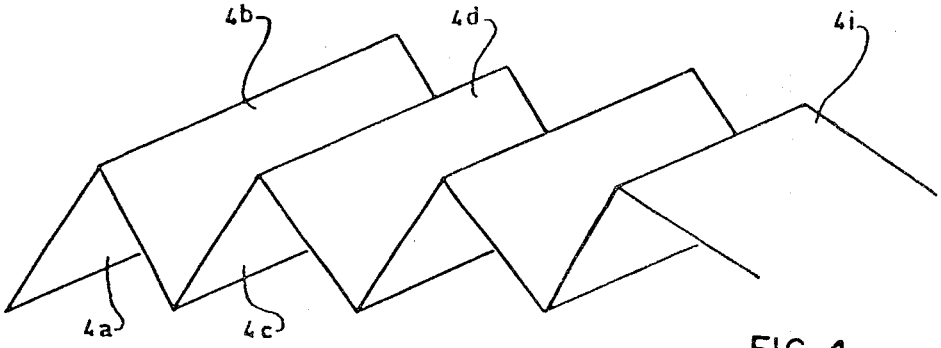

A strip of plaster plates such as shown in FIG. 2, provided in their thickness with folding lines 3*a*, 3*b* free from plaster, and constituted solely of the reinforcement fibers 2 reduced to a single plane along these folding lines, may be folded accordion-like to form the construction element shown FIG. 4, useful, for example for making decorative partitions or ceilings with many panels 4*a*, 4*b*, 4*c* . . . *4i* . . . .

Figure 5:
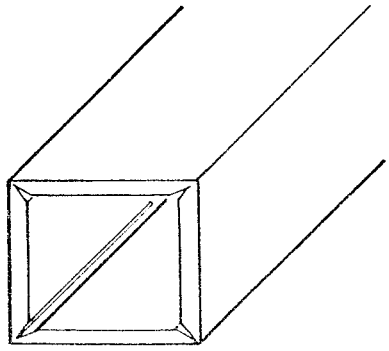
FIG. 5 shows a sheath or a duct made from a construction element according to the invention.

The same strip of panels may be folded as shown in FIG. 5 to constitute sheaths or ducts, for example sheaths to surround metallic structures and protect them from fire, an insulator being then inserted between the metallic structure and the plaster sheath, for example air ducts. The strip of plates 1 with several panels having received its operating form, accordion or other, may be blocked in that form by adhering together the surfaces of the two panels which come in contact following the folding. These two surfaces or section portions may be made to adhere to each other with plaster brought back into the interior of the fold, or with a thermofusible glue.

Figure 6:
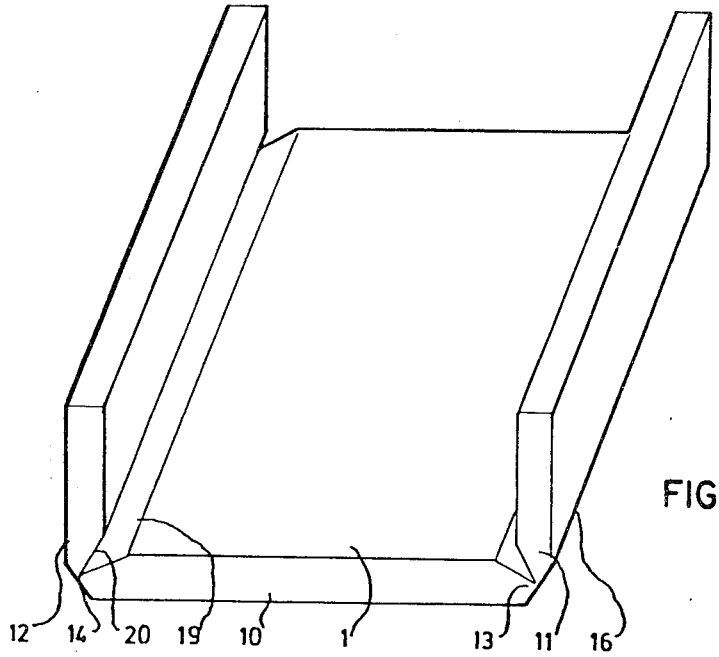
FIG. 6 shows a trough-like construction element.

As shown in FIG. 6, it is possible, starting with the same plaster plate 1 to fabricate construction modules according to the invention, possessing one main panel 10 and two secondary flaps or wings 11 nd 12 of lesser width, disposed each one one side of the main flap 10 and separated from said panel 10 by fold lines 13, 14, free from plaster, constituted solely by the reinforcement fibers 2 of the plate 1, assembled along these fold lines 3 in a single median plane while it is everywhere else distributed in the thickness of the product, either distributed uniformly in the thickness, or in a plurality of layers arranged at different levels.

The plaster limits of each fold line, pertaining on the one hand to a flap 11 or 12 and on the other hand to the main panel 10, has appreciably a profile like an open V of an angle close to 120°. These flaps 11 and 12 are raised in relation to the main flap 10 at an angle of approximately 90° to form a U-like trough. In any case, that angle is a function of the utilization that it is desired to make of these troughs. In certain cases which we shall consider further on, the flaps are raised at an angle slightly superior to 90°, viz. about 95° so as to form a slightly closed U-like trough. In other cases, on the contrary, they are raised at a lesser angle, about 85° so as to form a slightly open U-like trough.

Figure 7A:
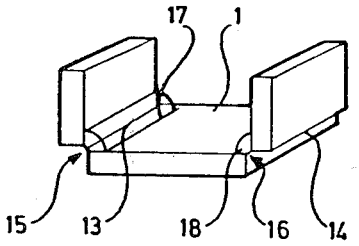
Figure 7B:
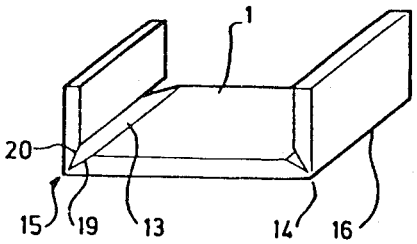

In the same manner, the level of the fold lines 13 and 14 in the thickness of the plates is a function of the use which it is desired to make of the troughs. The folding may be done around hinges of fold lines 13 and 14 situated as shown in FIG. 7A, at the level of the upper face of the plate 1, with edges 15 and 16 of the trough then assuming a profile of a staircase step. A reinforcement or some surplus glue or plaster, forming pads 17, 18 in the interior of the folds along the hinges of fold lines 13 and 14, is then necessary to maintain the flaps raised. The folding may be done around the hinges of lines 13 and 14 situated as shown in FIG. 7B at the level of the lower face of plate 1. The bottom edges 15 and 16 then have a clear right-angle profile. Each fold along the length of the hinges of fold lines 13 and 14 then shows two bevels 19 and 20 of maximum breadth, which may be glued one on top of the other. The folding may also be done around the hinges of fold lines 13 and 14 situated as shown FIG. 7C at any level in the thickness of the plates.

The edges 15 and 16 of the trough display a chamfered profile and the bevels 19 and 20 have an intermediate breadth between the maximum breadth that they had in the case of FIG. 7B and the zero breadth in the case of FIG. 7A.

Figure 8:
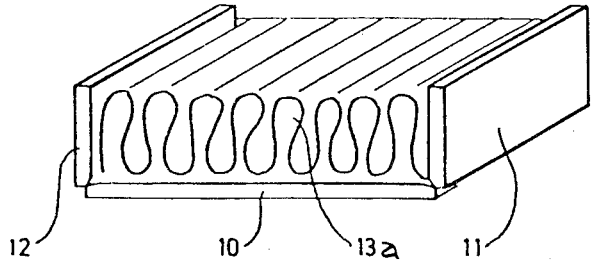

The two flaps 11 and 12 have a height in the range of 1/40th of the width of the module, viz. about 5 centimeters for 2 meters of width. Plaster or thermofusible glue may be brought back to the interior of the two folds. The trough thus constituted serves as a support for heat insulation 13*a*, mineral wool or foam of the polystyrene type or phenolic foam, as shown in FIG. 8. Advantageously, the insulation is glued to the flaps 11 and 12 and is also glued to the plate 10. Such a module has an increased rigidity due to the flaps and likewise due to the fact that the reinforcement was left intact at the level of the hinge of the fold lines, that it will not be put in tension, and that it will not be separated from the plaster.

Thus a plate of plaster, planar, with a thickness of 6 millimeters, reinforced by a sheet of continuous glass fibers, entangled and curled, of a 150 grams per square meter mass, and by two lattices of glass fibers, one above, the other below, of 15 grams each per square meter, assumes on a two meter length a 13 centimeter arrow under its own weight and even begins to crack. The same plate with the same reinforcements, but provided with two flaps of a 6 centimeter height, connected to the main panel by the reinforcement brought back in a plane along the folding lines, filled with an insulator of glass wool of 10 centimeter of thickness and of 13 kilograms per cubic meter, assumes no arrow under its own weight, still on a 2 meter length.

In order to achieve such construction elements, it is necessary to begin by manufacturing plates 1 made of reinforced plaster. To do that, one must cast discontinuously, or continuously as described in the French application No. 78.03475, a liquid mixture of plaster and of water, of a fluidity in excess of FLS 120. The FLS Test provides an expression of the fluidity in millimeters. That test is a test currently used by the manufacturers of plaster and it indicates the behavior of a plaster when it is cast. It consists in filling a hollow cylinder with a 60 millimeter diameter and a 59 millimeter height, placed vertically in the center of a polished metal plate, or a glass one, with a water-mixed plaster. At the T time detected in relation to the to time of the placing of the powdery plaster in contact with the water, the cylinder is raised and the plaster is thus released, spreading on the plate to form a disk, the diameter of which is measured. The measurement of that diameter constitutes the reference to fluidity F at the time T.

A reinforcement is introduced in the liquid mixture, either before the casting especially when working discontinuously, or indifferently before, during, or after the casting as described in the already mentioned application No. 78.03475 when working continuously.

One begins modifying the position of the reinforcement along the lines which will become the fold lines and to concentrate the reinforcement along these lines preferentially in a single plane while the mixture of plaster is still liquid, that is to say at a moment when its FLS fluidity is not inferior to 100, and this in such a way that the plaster will take a hold on a reinforcement whose position will no longer vary. Thus the anchoring of the reinforcement in the plaster wall will not be modified. The action maintained to modify the position of the reinforcement along these lines at least until the plaster holds by itself, that is to say until an FLS fluidity close to 60. When it is desired to position the folding line appreciably at mid-height in the thickness of the strip of plaster, an action is exerted at the same time on the top and on the bottom of the plaster plate.

When the plane of the fold lines is pushed back at the level of the faces of the strip 1, an action is exerted either solely on the upper face in order to drive in the reinforcement to the lower face, or solely on the lower face to raise the reinforcement to the immediate proximity of the upper face. In addition, one must prevent the mixture from placing itself plumb with the fold lines, or at least from the moment when the plaster has attained an FLS fluidity equal to 60, these fold lines are freed from the plaster that is there. This action may be begun before the plaster has attained the FLS 60 fluidity, but if one wishes that the grooves which has thus been made does not get filled up again with liquid mixture, it must be continued until the fluidity be at 60 or close to 60. Of course, the panel may be allowed to dry with only the reinforcement concentrated along certain lines, without removing the plaster plumb with these lines, that removal being done later when the panel is dry, for example at the time of use, without risking deterioration of the reinforcement as same is well concentrated in a single plane and does not buckle any longer in the whole thickness. When the work is done discontinuously, fillets are placed in the bottom of the mold which maintains the reinforcement raised along the fold lines, and pressure is exerted on the top of the panel with steelwork that is positioned exactly over the fillets. Steelwork and fillets thus bring the reinforcement back in a single plane along the future fold lines and also prevent the mixture from setting on the fold lines. When the work is done continuously as described in the French application No. 7803475 already quoted in a first mode of realization, the bed of the casting may be provided at the place of the fold lines with fillets that move along with it.

Figure 9:
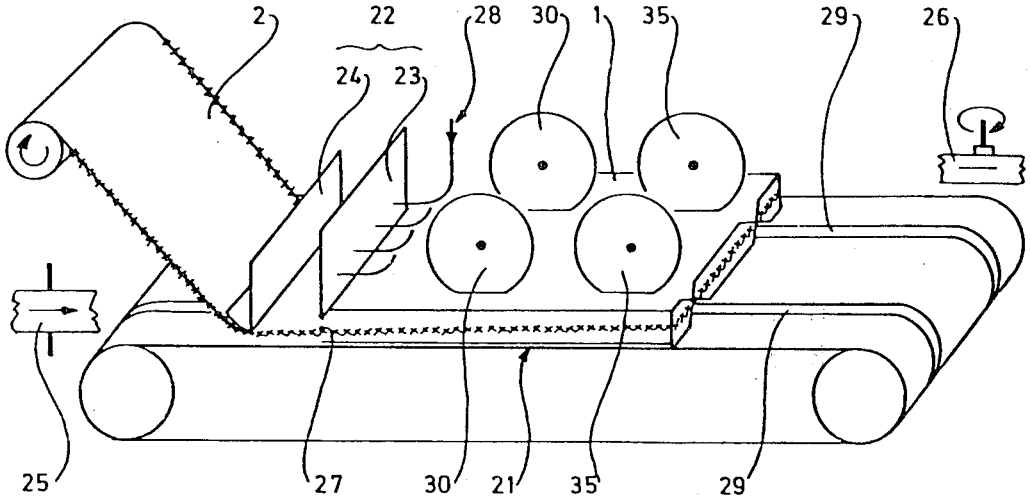

As stated in that application and as shown in FIG. 9, a casting bed 21 is movable and on it is placed a bottomless reservoir 22, made of two plates, a downstream plate 23 and an upstream plate 24, and of travelling strips or edges 25, 26 of the casting bed, of rubber, which move at the same speed as the bed of the casting by contacting the lateral edges of the plates downstream and upstream. The reservoir 22 is provided with a casting hole 27 under the downstream plate 23 and it is fed continuously by horizontal jets 28 of a liquid mixture of plaster and water, which jets ensure a continuous stirring of the mixture contained in the reservoir 22 and which prevent its setting as a mass.

The reinforcement 2 in the form of a sheet of glass fibers and/or lattices of glass fibers is, for example, introduced under the casting reservoir 22 and thus finds itself confined in the cast layer of mixture and drawn on the casting bed with the said layer.

The casting bed being provided with protruding fillets 29, the reinforcement finds itself raised by these fillets, plumb with these fillets, while everywhere else it retains its position. When the folding lines are to be situated appreciably at mid-thickness in the plaster plate, plumb with the fillets, above the strip of the casting plaster, a plurality of disks 30 is disposed which drive in the reinforcement.

When the fold lines are at the level of the lower face of the strip of plates, solely driving in disks 30 are used, without fillets on the casting bed; on the other hand, when the folding lines must be at the level of the upper face, one uses solely fillets the height of which are barely lower or even equal to the thickness of the plates.

Figure 10:
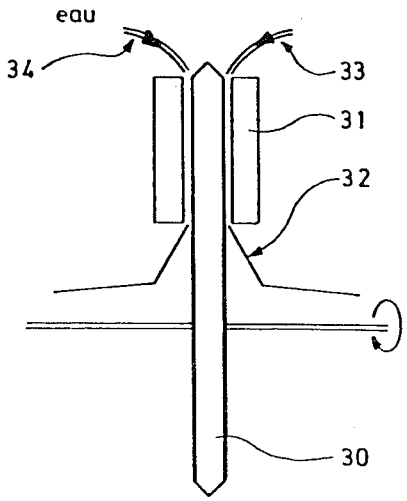

These disks 30 as shown in detail in FIG. 10 are revolving, for example, in lucoflex or in p.v.c., and are 150 millimeters in diameter and are 3 millimeters thick with an edge forming a 120° angle.

In order to prevent clogging of the disks 30, their sides are rubbed with rubber hip-leads 31 mounted in boxes 32 provided with drainage. Above the said hip-leads 31, pipes 33 and 34 spray the flanks of the disks 30. The water is scraped by the hip-leads 31 and it is eliminated by the drainage of the boxes.

To finish off the fold lines and/or to free them from the plaster which is there, releasing disks 35 identical to disks 30 are used.

The disks 30 and the disks 35, when they act before the plaster has set around the FLS fluidity 60, create on each side of the fold lines, pads of material which, when the panels are folded, increase the width of the bevels 19 and 20 (FIG. 7B) in contact.

Figure 11:
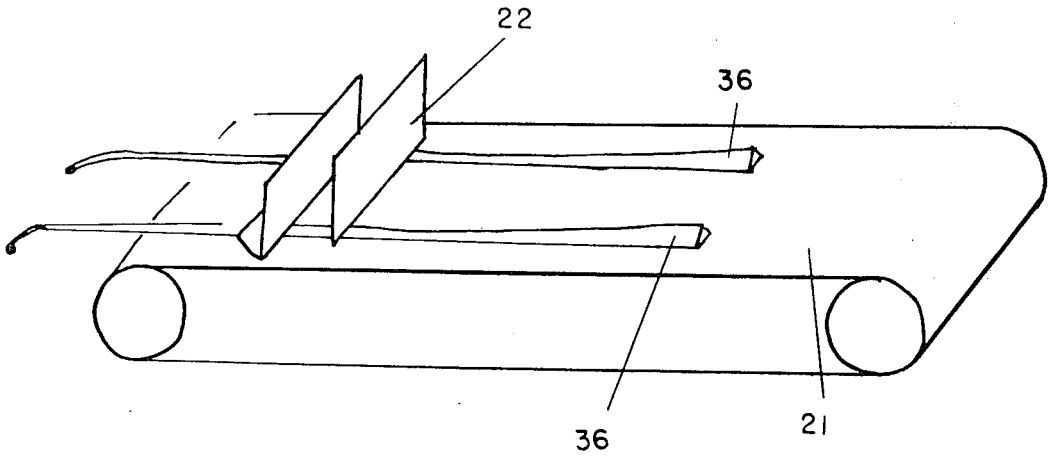

In a second method of realization, schematized in FIG. 11, when still working continuously as described in the French application No. 78.03475, it is possible to anchor upstream of the reservoir of casting 22, flat steelworks 36 which are placed on the casting bed 21, which pass under the casting reservoir 22, which are parallel to the direction of the advance of the said bed, to the spots where it is desired to create concentration lines of the reinforcement and the flat form of which is progressively transformed downstream of the casting reservoir to take a triangle section and constitute a fillet capable of raising the reinforcement. Only the upstream extremity of these steelworks 36 is anchored, the other extremity is left free. They have a length such as to ensure the raising of the reinforcement in the thickness of the plaster strip, until into a zone where the said reinforcement confined in the plaster, is sufficiently maintained by the hardened plaster so as to retain the modified position which has been given to it, that is to say in a zone where the plaster has attained the F.L.S. 60 fluidity or close to 60. Thus p.v.c. or lucoflex steelwork, flat as long as they are upstream of the casting reservoir or under the said reservoir, then progressively transforming themselves, to take a triangle section, equilateral for example, of a length of 1.50 meters downstream of the casting reservoir from a height in their portion of triangle section of 2 to 3.5 millimeters when it is desired to manufacture plates of plaster of 6 millimeter thickness, are suitable.

As in the first method of realization, releasing disks 35 may be employed to remove the plaster plumb with the fold lines where the reinforcement has been concentrated.

Advantageously, these construction modules in the form of a trough, provided or not with an insulator, may be used for ceilings. In view of the resistance to flection, it is possible for them to have spins in excess of 2.50 meters and two modules placed end to end, are capable of making practically the width of all the pieces. In order to put them in place between two purlins of the roofing or between two beams, the two extremities of the troughs are placed in support on a bracelath or steelwork fixed along each purline or each beam.

When two lengths of troughs are necessary to cover the width of a piece, one may add a carrier beam in the middle of the piece, or use a support steelwork in the form of an upside down T. hooked to the rafters to the roof for instance, the wings of the base of the T fitting into slits made at the extremities of the troughs along the hinge over a length equal to the length of the wing of the T, viz. about 2 centimeters.

The troughs thus being mounted jointedly, it is possible either to apply a coating at their juncture, or to leave them side by side without any coating.

Figure 7C:
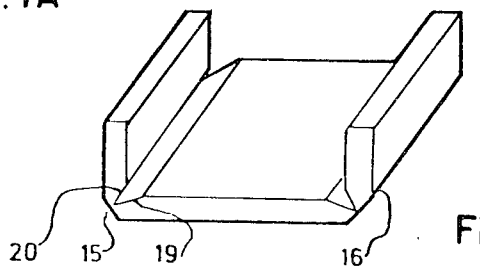

In case it is desired to joint them with a coating, the troughs to be used are preferentially troughs for which the ridges 15 and 16 shown in FIGS. 7 are chamfered (FIG. 7C) or have a staircase profile (FIG. 7A). Moreover, troughs are chosen preferentially whose flaps have been raised only at an angle lower than 90°, viz. 85°, in such a way as to have an open U-like form.

There is thus the possibility of placing a sufficient quantity of coating, a minimum of coating of 5 millimeters in width, which allows the said coating to absorb eventual dimensional instabilities of the panels, resulting from variations of temperature.

The reinforcement fibers at the level of the hinges being bare, the coating clings to them perfectly.

In case only a dry mounting is desired, that is to say without coating, troughs preferentially are selected with a distinctly right angle edge as shown FIG. 7B. It is possible to glue together the flaps of two contiguous troughs and at that moment, troughs are preferentially selected whose edges are at exactly 90° or even raised beyond 90°, 95° for instance, to form a slightly closed U.

Such troughs may equally be assembled to constitute sheaths or ducts.

The realization of troughs according to the invention is equally possible with materials other than plaster, cement for example.

The expressions "the reinforcement" or "the reinforcements" used in this description are used indifferently whether there be only one reinforcement or there be several of them combined.

We claim:

1. Process of manufacture of construction elements in the form of a plate including expanded reinforcements distributed throughout the greater part of its thickness, characterized in that along lines parallel to the faces of the plto form fold lines or hinges separating said plate into a plurality of articulated panels, comprising the steps of:

forming a plate by casting a liquid mixture of plaster and of water and by introducing expanded requirements therein throughout the thickness of the plate in the form of curled entangled fibers;

concentrating portions of the reinforcements by compressing to a reduced thickness said reinforcements to form fold lines separating said plate into a plurality of articulated panels;

evolving the setting of the plaster; and maintaining the reinforcement in position along these fold lines during the evolution of the setting of the plaster until the plaster hardens sufficiently to retain the reinforcement in said position.

2. Process according to the claim 1, including eliminating the plaster plumb with these fold lines.

3. Process according to claim 1, including concentrating the reinforcement along the fold lines before the mixture of plaster and water has attained a consistency which corresponds to the FLS Fluidity equal to 100 so that the plaster and water mixture is still fluid enough to permit movement of the reinforcement, and maintaining the concentration at least until the mixture has attained an FLS fluidity close to 60 so that the plaster and water mix is stiff enough to hold the reinforcement in place.

4. Process according to claim 2 including removing the plaster plumb with the fold lines along which the reinforcements are concentrated, after the mixture has attained the FLS fluidity equal to 60 and has become stiff enough so that the mixture does not fill the hole created by the removed plaster.

5. The process of claim 1, wherein the process is a continuous one and includes the steps of introducing a sheet of reinforcing fibers under a bottomless casting reservoir having a downstream plate and an upstream plate, said casting reservoir being formed on bottom and sides by a movable bottom casting bed with travelling side edges;

pouring a plaster and water mixture into the casting reservoir;

moving the reinforcing fibers and mix out of the reservoir;

compressing selected portions of the reinforcing fibers to a reduced thickness to form fold lines, separating said plate into a plurality of articulated panels and removing the plaster at the fold lines.

6. The process of claim 5, wherein the compressing is done by raising said selected portions of the reinforcing fibers by passing them over fillets.

7. The process of claim 5, wherein the compressing is done by lowering said selected portions of the reinforcing fibers by passing them under disks.

8. The process of claim 5, wherein the compressing is done by raising said selected portions of the reinforcing fibers by passing them over fillets, and by lowering said selected portions of reinforcing fibers by passing them under disks.

* * * * *